US005616454A

United States Patent [19]

Kaneko et al.

[11] Patent Number: 5,616,454

[45] **Date of Patent: *Apr. 1, 1997**

[54] SILVER HALIDE COLOR PHOTOGRAPHIC LIGHT-SENSITIVE MATERIAL

[75] Inventors: Manabu Kaneko; Shinri Tanaka; Michiko Nagato, all of Hino, Japan

[73] Assignee: Konica Corporation, Japan

[ * ] Notice: The term of this patent shall not extend beyond the expiration date of Pat. No. 5,576,166.

[21] Appl. No.: 565,824

[22] Filed: Dec. 1, 1995

[30] Foreign Application Priority Data

Dec. 12, 1994 [JP] Japan ..... 6-307644

[51] Int. Cl.[6] ..... G03C 7/38

[52] U.S. Cl. ..... 430/554; 430/555

[58] Field of Search ..... 430/554, 555

[56] References Cited

U.S. PATENT DOCUMENTS 5,275,926 1/1994 Hirabayashi et al. ..... 430/555

FOREIGN PATENT DOCUMENTS 0686872 12/1995 European Pat. Off. .
3628318 2/1988 Germany ..... 430/555
150421 6/1993 Japan .
1552701 9/1979 United Kingdom ..... 430/555

*Primary Examiner*—Lee C. Wright
*Attorney, Agent, or Firm*—Jordan B. Bierman; Bierman and Muserlian

[57] ABSTRACT

A silver halide color photographic light-sensitive material is disclosed. The light-sensitive material comprises a support, provided thereon, a blue-sensitive silver halide emulsion layer, a green-sensitive silver halide emulsion layer and a red-sensitive silver halide emulsion layer, and the green-sensitive emulsion layer contains a coupler represented by the following Formula I;

Formula I wherein $R_1$ is a hydrogen atom or a group capable of being released upon reaction with the oxidation product of a color developing agent; $R_2$ is a chlorine atom or an alkoxyl group; $R_3$ and $R_4$ are each independently a hydrogen atom or a substituent, provided that when $R_3$ is a hydrogen atom, $R_4$ is a substituent; and $R_5$, $R_6$, $R_7$, $R_8$ and $R_9$ are each a halogen atom.

3 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, particularly relates to a silver halide color light-sensitive material having a high sensitivity and a high color forming efficiency.

BACKGROUND OF THE INVENTION

In a usual color photographic material, a substructive color reproduction system is used. Accordingly, a color image is formed by a combination of three dyes each derived from a yellow dye-forming coupler, magenta dye-forming coupler and cyan dye-forming coupler, respectively.

As the magenta dye-forming coupler, hereinafter simply referred as "magnet coupler", pyrazolone type, pyrazolinobenzimidazole type and indanone type couplers have been known. Among them, various 5-pyrazolone derivatives are widely used.

As a substituent to be bonded at 3-position of 5-pyrazolone ring of the 5-pyrazolone derivatives, for example, an alkyl group, an aryl group, an alkoxyl group described in U.S. Pat. No. 2,439,098, an acylamino group described in U.S. Pat. Nos. 2,369,489 and 2,600,788, and a ureido group described in No. 3,558,319 are used. However such couplers have some defects such as that the coupling activity with the oxidation product of a color developing agent is low and a magenta image having a high optical density is difficultly obtained, a magenta dye image obtained by color development has a strong secondary absorption at blue-light region and sharpness of cut-off of the main absorption of the dye at the long wavelength end thereof is insufficient.

3-anilino-5-pyrazolone type couplers described in U.S. Pat. Nos. 2,311,081, 13,677,764 and 3,684,514, BP Nos. 956,261 and 1,173,513 each has a high coupling activity and a high color forming efficiency and the dyes formed from the couplers have a small unnecessary adsorption in the red-light region. However, a color negative film is further demanded to have a higher sensitivity and a higher color forming efficiency than those of a light-sensitive material using the above 3-anilino-5-pyrazolone type couplers.

SUMMARY OF THE INVENTION

The first object of the invention is to provide a silver halide color photographic material having a high sensitivity and a high color forming efficiency.

The second object of the invention is to provide a silver halide color photographic light-sensitive material which have a layer reduced in the thickness and is excellent in the sharpness of image.

The above-mentioned objects of the invention is attained by a silver halide color photographic light-sensitive material comprising a support, provided thereon, a blue-sensitive silver halide emulsion layer, a green-sensitive silver halide emulsion layer and a red-sensitive silver halide emulsion layer, in which the green-sensitive emulsion layer contains a coupler represented by the following Formula I;

Formula I

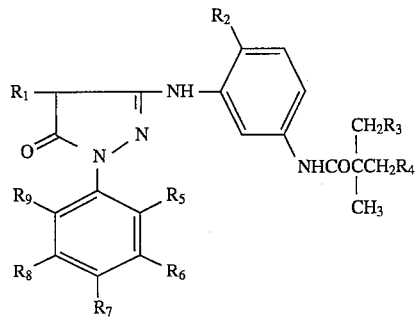

wherein $R_1$ is a hydrogen atom or a group capable of being released upon reaction with the oxidation product of a color developing agent; $R_2$ is a chlorine atom or an alkoxyl group; $R_3$ and $R_4$ are each independently a hydrogen atom, an alkyl group, an aryl group, an alkoxyl group, an aryloxy group, an acyloxy group, a halogen atom, a hydroxyl group, an amino group, an alkylamino group, an acylamino group or a sulfonamido group, $R_3$ and $R_4$ may be linked with together to form a ring, provided that when $R_3$ is a hydrogen atom, $R_4$ is an alkyl group, an aryl group, an alkoxyl group, an aryloxy group, an acyloxy group, a halogen atom, a hydroxyl group, an amino group, an alkylamino group, an acylamino group or a sulfonamido group; $R_5$, $R_6$, $R_7$, $R_8$ and $R_9$ are each a halogen atom.

DETAILED DESCRIPTION OF THE INVENTION

The coupler of the invention represented by Formula I is described below.

In Formula I, $R_1$ is a hydrogen atom or a group capable of being released upon reaction with the oxidation product of a color developing agent. From the viewpoint of color forming efficiency, it is preferable that the group represented by $R_1$ is a group capable of being released upon reaction with the oxidation product of a color developing agent. Examples of the group capable of being released upon reaction with the oxidation product of a color developing agent include a phenylthio group, a carboxy-propylthio group and a octylthio group. Among them, a phenylthio group, particularly a phenylthio group is preferable from the viewpoint of color forming efficiency. A phenylthio group having an acylamino group at the ortho-position with respect to the sulfur atom is particularly preferable for obtaining a high color forming efficiency.

$R_2$ is a chlorine atom or an alkoxyl group such as a methoxy group, ethoxy group, iso-propyloxy group, t-butyloxy group or a hexyloxy group.

$R_3$ and $R_4$ are each independently a hydrogen atom or a substituent provided that when $R_3$ is a hydrogen atom, $R_4$ is a substituent. The substituent is an alkyl group such as a methyl group, ethyl group or iso-propyl group, an aryl group such as a phenyl group or p-methoxyphenyl group, an alkoxyl group such as a methoxy group, ethoxy group or t-butoxy group, an aryloxy group such as a phenoxy group of tolyloxy group, an acyloxy group, a halogen atom such as a fluorine atom, chlorine atom or bromine atom, a hydroxyl group, an amino group, an alkylamino group, an acylamino group or a sulfonamido group. The groups represented by $R_3$ or $R_4$ each may have a substituent. Groups each to be the substituent of $R_3$ or $R_4$ include the group the same as those described as the groups represented by $R_3$ or $R_4$. $R_3$ and $R_4$ may be linked with together to form a 3- to 6-member ring. It is preferable that at least one of $R_3$ and $R_4$ is a group represented by —$OR_{10}$ or —$OOCR_{11}$ in which $R_{10}$ is a hydrogen atom, an alkyl group or an aryl group and $R_{11}$ is an alkyl group or an aryl group.

$R_5$, $R_6$, $R_7$, $R_8$ and $R_9$ are each independently a halogen atom such as a fluorine atom, chlorine atom or bromine atom. It is preferable that $R_5$, $R_6$, $R_7$, $R_8$ and $R_9$ are each a chlorine atom by the reason of that a dye having a maximum spectral absorption at a preferable wavelength can be obtained from such coupler and a raw material of such coupler can be easily available with a low cost.

Typical examples of the coupler represented by Formula I described below.

Exemplified compound

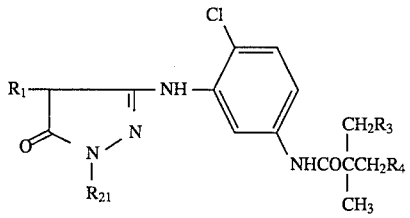

| | $R_1$ | $R_3$ | $R_4$ | $R_{21}$ |
|---|---|---|---|---|
| 1 | 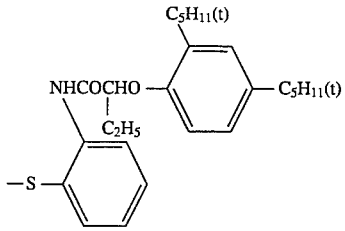 | —H | —$CH_2CH_3$ | 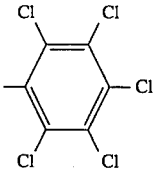 |
| 2 | " | " | —$CH_3$ | " |
| 3 | " | " | —Cl | " |
| 4 | " | " | —$CH_2CH{=}CH_2$ | " |
| 5 | " | " | —$CH_2CH_2CH_3$ | " |
| 6 | " | " | —$OCH_2CH_3$ | " |
| 7 | " | " | —$OC_4H_9$ | " |
| 8 | " | " | —$OOCCH_3$ | " |
| 9 | " | " | —$OOCC_4H_9(t)$ | " |
| 10 | " | " | —$OOCC_9H_{19}$ | " |
| 11 | " | " | 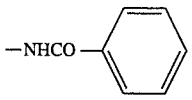 | " |
| 12 | " | " | 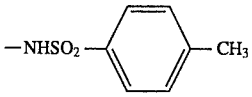 | " |
| 13 | " | —$CH_3$ | —$CH_3$ | " |
| 14 | " | —$OCH_3$ | —$OCH_3$ | " |
| 15 | " | —$OOCC_4H_9$ | —$OOCC_4H_9$ | " |
| 16 | 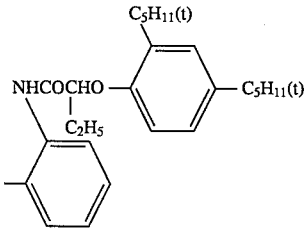 | —Cl | —Cl | 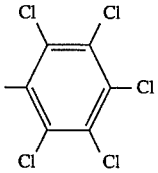 |
| 17 | —H | —H | —$CH_2CH_3$ | " |
| 18 | " | " | —$CH_3$ | " |
| 19 | " | " | —$OC_4H_9$ | " |
| 20 | " | " | —$OOCC_4H_9$ | " |
| 21 | " | " | 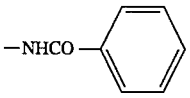 | " |

-continued

Exemplified compound

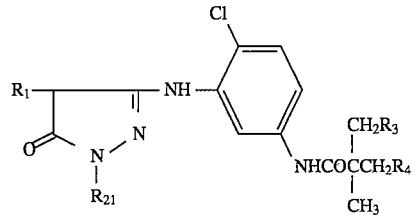

| | $R_1$ | $R_3$ | $R_4$ | $R_{21}$ |
|---|---|---|---|---|
| 22 | " | " | 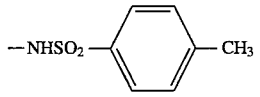 | " |
| 23 | " | $-CH_3$ | $-CH_3$ | " |
| 24 | " | $-OOCC_4H_9$ | $-OOCC_4H_9$ | " |
| 25 | 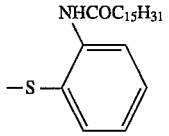 | $-H$ | $-CH_2CH_3$ | " |
| 26 | " | " | $-OOCC_4H_9$ | " |
| 27 | 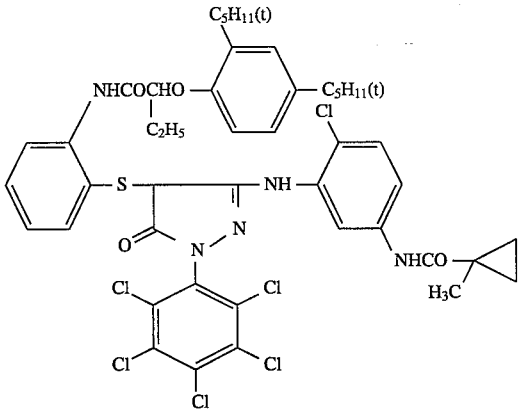 | | | |
| 28 | 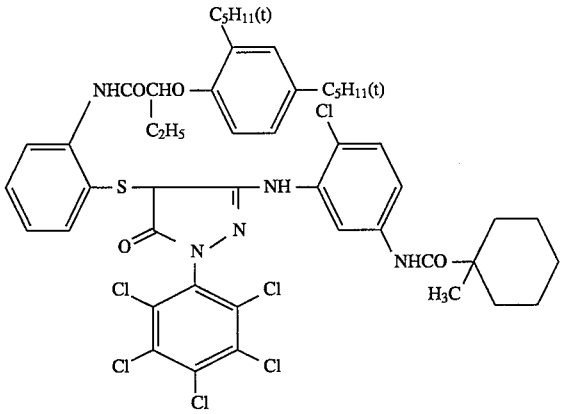 | | | |

Examples of synthesis of the magenta couplers represented by Formula I of the invention are described below. However, the couplers of the invention can be synthesized referring usual synthesis method described in, for example, U.S. Pat. Nos. 2,369,489, 2,376,380, 2,472,581, 2,600,788, 2,933,391 and 3,615,506, BP Nos. 956,261 and 1,134,329 and JP No. 45-1970 and JP O.P.I. No. 2-39148/1990.

Synthesis example 1

Synthesis of exemplified compound 17

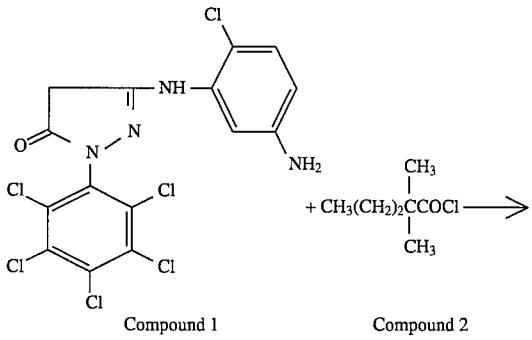

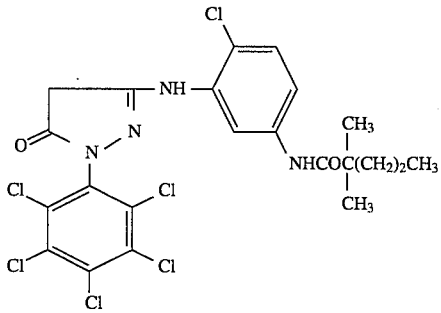

Exemplified compound 17

To 1.85 g of 2,2-dimethyl-n-valeric acid, 3 ml of thionyl chloride is added, and the mixture is heated for 2 hours at −70° C. Then thionyl chloride is removed under vacuum to obtain a pale yellow colored oil or Compound 2.

To 4.73 g of Compound 1, 27 ml of ethyl acetate, 10 ml of water and 2.46 g of sodium acetate anhydride were added and stirred. While stirring, Compound 2 was further added to the above mixture. After stirring for 30 minutes, 50 ml of hexane and precipitated matter was filtered. Colorless raw crystals were obtained by recrystalizing the filtered precipitation with 80 ml of acetonitoryl. The raw crystals were further recrystalized by making use of 80 ml of toluene. Thus 2.81 g of exemplified Compound 17 was obtained with a yield of 48.0%.

The chemical structure of above obtained compound 17 was confirmed with the NMR spectrum and mass spectrum thereof.

Synthesis example 2

Synthesis of exemplified compound 1

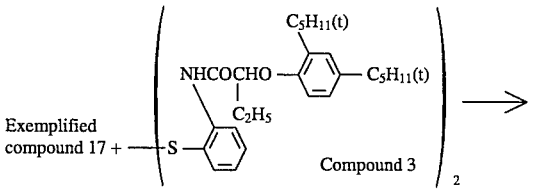

Exemplified compound 1

To 2.34 g of exemplified Compound 17, 30 ml of N,N-dimethylformamide and 1.79 g of Compound 3 was added. The mixture was heated by 80°–90° C. and 0.32 g of bromine dissolved in 10 ml of N,N-dimethylformamide was further added to the mixture. The mixture was heated at 80°–90° C. for 3 hours and stood for cooling. After cooling, the mixture was poured into 150 ml of water. Thus white crystals were precipitated.

Then the precipitate was filtered. The filtered white crystals were purified by silica gel chromatography and recrystalized with 50 ml of acetontoryl. Thus 1.98 g of milky-white crystals of exemplified Compound 1 was obtained with a yield of 49.0%.

The chemical structure of above obtained compound 1 was confirmed with the NMR spectrum and mass spectrum thereof. The melting point of the compound was 155°–156° C.

In the color photographic light-sensitive material of the present invention, the magent coupler represented by Formula I is contained in a green-sensitive emulsion layer.

The magenta coupler of the invention is usually used in an amount of $1\times10^{-3}$ to $8\times10^{-1}$ moles, preferably $1\times10^{-2}$ to $8\times10^{-1}$ moles, per mol of silver contained in the emulsion layer in which the coupler to be contained.

The magenta coupler represented by Formula I may be used together with another kind of magenta coupler.

An usual method ca be used to contain the magenta coupler represented by Formula I in a silver halide photographic light-sensitive material. For example, a well known method by the following procedure can be applied. The coupler of Formula I is dissolved in a low-boiling solvent such as butyl acetate or ethyl acetate or a mixture of the low-boiling solvent and a high-boiling solvent such as dibutyl phthalate or tricresyl phosphate. Then the solution is mixed with an aqueous solution containing a surfactant and gelatin and dispersed and emulsified by a high-speed rotating mixer, a colloid mill or a ultrasonic dispersion apparatus. Thus obtained dispersion is directly added to a silver halide emulsion. In another way, the dispersion may be added to a silver halide emulsion after setting, cutting and washing.

Although the magenta coupler of Formula I may be dissolved in a low-boiling solvent and dispersed, it is more preferable to be dissolved in a mixture of a low-boiling solvent and a high-boiling solvent and dispersed in advance of addition to the emulsion.

The adding amount of the high-boiling solvent is preferably 0.01 g to 10 g, more preferably 0.1 to 3.0 g per gram of the coupler of Formula I.

In the light-sensitive martial of the invention, an usual silver halide photographic emulsion can be arbitrary used. The emulsion may be chemically sensitized by an usual method and may be spectrally sensitized for required wavelength region by an optical sensitizing dye.

An antifoggant and a stabilizer may be added to the silver halide emulsion. In the silver halide emulsion, gelatin is advantageously used.

A silver halide emulsion layer or another hydrophilic colloid layer of the light-sensitive material may be hardened, and a Plasticizer or a dispersion of a water-insoluble or hardly soluble synthesized polymer or latex may be contained in these layers. In emulsion layers of a color photographic light-sensitive material, various kinds of couplers can be contained.

Further, a colored coupler and competing coupler for color compensation, and a compound capable of releasing a photographically effective fragment such as a development accelerator, bleaching accelerator, developing agent, silver halide dissolving agent, toning agent, hardener, antifoggant, chemical sensitizer, optical sensitizer or desensitizer, upon coupling reaction with the oxidation product of a color developing agent.

As the support of the light-sensitive material, a paper laminated by a polyethylene layer, polyethylene-terephthalate film, baryta paper and cellulose triacetate film.

The light-sensitive material of the invention can be processed by an usual color photographic processing method after imagewise exposure to form a color image.

EXAMPLES

Example 1

In the followings, the amounts of compositions of light-sensitive material are described in grams per square meter, and the amounts of silver halide and colloidal silver are described in terms of silver. The amounts of sensitizing dyes are described in moles per mole of silver.

A side triacetyl cellulose film support was subbed. Backing layers each having the following compositions were coated on the surface of the support opposite to the subbed surface in the following order from the support.

| | |
|---|---|
| 1st backing layer | |
| Alumina sol AS-100 (aluminum oxide produced by Nissan Kagaku Kogyo Co.) | 0.1 g |
| Diacetyl cellulose | 0.2 g |
| 2nd backing layer | |
| Diacetyl cellulose | 100 mg |
| Stealic acid | 10 mg |
| Fine silica particles (average size: 0.2 μm) | 50 mg |

Layers each having the following compositions were coated on the subbed surface of thus prepared support in the following order from the support to prepare Sample 1.

| | |
|---|---|
| 1st layer: Antihalation layer (HC) | |
| Black colloidal silver | 0.15 |
| UV absorbent (UV-1) | 0.20 |
| Colored cyan coupler (CC-1) | 0.02 |
| High-boiling solvent (Oil-1) | 0.20 |
| High-boiling solvent (Oil-2) | 0.20 |
| Gelatin | 1.6 |
| 2nd layer: Interlayer (IL-1) | |
| Gelatin | 1.3 |
| 3rd layer: Low-speed red-sensitive emulsion layer (R-L) | |
| Silver iodobromide emulsion (average grain size: 0.3 μm) (average iodide content: 2.0 mol %) | 0.4 |
| Silver iodobromide emulsion (average grain size: 0.4 μm) (average iodide content: 8.0 mol %) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High-boiling solvent (Oil-1) | 0.55 |
| Gelatin | 1.0 |
| 4th layer: High speed red-sensitive emulsion layer (R-H) | |
| Silver iodobromide emulsion (average grain size: 0.7 μm) (average iodide content: 7.5 mol %) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (D-2) | 0.02 |

-continued

| | |
|---|---|
| High-boiling solvent (Oil-1) | 0.25 |
| Gelatin | 1.0 |
| 5th layer: Interlayer | |
| Gelatin | 0.8 |
| 6th layer: Low speed green-sensitive emulsion layer (G-L) | |
| Silver iodobromide emulsion (average grain size: 0.4 μm) (average iodide content: 8.0 mol %) | 0.6 |
| Silver iodobromide emulsion (average grain size: 0.3 μm) (average iodide content: 2.0 mol %) | 0.2 |
| Sensitizing dye (S-4) | $6.7 \times 10^{-4}$ |
| Sensitizing dye (S-5) | $0.8 \times 10^{-4}$ |
| Magenta coupler (M-a) | 0.35 |
| Colored magenta coupler (CM-1) | 0.05 |
| DIR compound (D-3) | 0.02 |
| Additive 1 | 0.10 |
| High-boiling solvent (Oil-2) | 0.7 |
| Gelatin | 1.0 |
| 7th layer: High speed green-sensitive emulsion layer (G-H) | |
| Silver iodobromide emulsion (average grain size: 0.7 μm) (average iodide content: 7.5 mol %) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-a) | 0.20 |
| Colored magenta coupler (CM-1) | 0.02 |
| DIR compound (D-3) | 0.004 |
| High-boiling solvent (Oil-2) | 0.35 |
| Additive 1 | 0.07 |
| Gelatin | 1.0 |
| 8th layer: Yellow filter layer (YC) | |
| Yellow colloidal silver | 0.1 |
| Additive (SC-1) | 0.12 |
| High-boiling solvent (Oil-2) | 0.15 |
| Gelatin | 1.0 |
| 9th layer: Low speed blue-sensitive emulsion layer (B-L) | |
| Silver iodobromide emulsion (average grain size: 0.3 μm) (average iodide content: 2.0 mol %) | 0.25 |
| Silver iodobromide emulsion (average grain size: 0.4 μm) (average iodide content: 8.0 mol %) | 0.25 |
| Sensitizing dye (S-9) | $5.8 \times 10^{-4}$ |
| Yellow coupler (Y-1) | 0.6 |
| Yellow coupler (Y-2) | 0.32 |
| DIR compound (D-1) | 0.003 |
| DIR compound (D-2) | 0.006 |
| High-boiling solvent (Oil-2) | 0.18 |
| Gelatin | 1.3 |
| 10th layer: High speed blue-senitive emulsion layer (B-H) | |
| Silver iodobromide emulsion (average grain size: 0.8 μm) (average iodide content: 8.5 mol %) | 0.5 |
| Sensitizing dye (S-10) | $3 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High-boiling solvent (Oil-2) | 0.05 |
| Gelatin | 1.0 |
| 11th layer: 1st protective layer (PRO-1) | |
| Silver iodobromide emulsion (average grain size: 0.08 μm) | 0.3 |
| UV absorbent (UV-1) | 0.07 |
| UV absorbent (UV-2) | 0.10 |
| High-boiling solvent (Oil-1) | 0.07 |
| High-boiling solvent (Oil-3) | 0.07 |
| Gelatin | 0.8 |

-continued

| 12th layer: 2nd protective layer (PRO-2) | |
|---|---|
| Compound A | 0.04 |
| Compound B | 0.004 |
| Polymethyl methacrylate (average particle size: 3 μm) | 0.02 |
| Copolymer of methyl methacrylate, ethyl methacrylate and mathacrylic acid, in the ratio of 3:3:4 by weight (average particle size: 3 μm) | 0.13 |
| Gelatin | 0.5 |

The above-mentioned Sample 1 further contains dispersing aid SU-1, coating aid SU-2, hardener H-1, Stabilizer ST-1, antimold agent DI-1, antifoggants AF-1 and AF-2, and dyes AI-1 and AI-2.

C-1

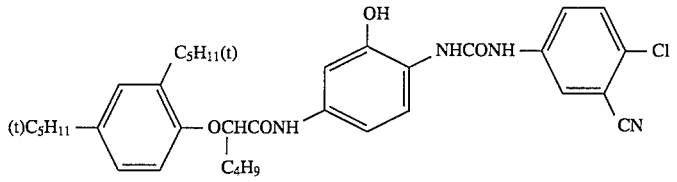

C-2

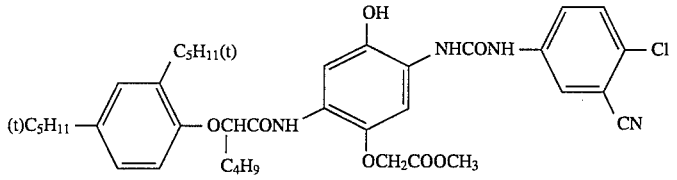

(Comparative coupler)

M-a

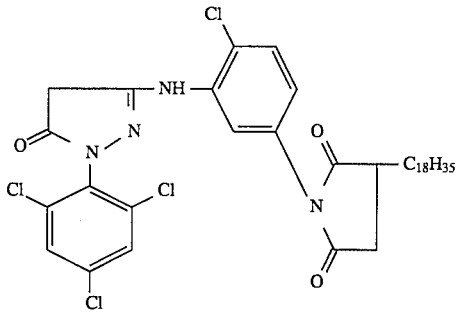

CM-1

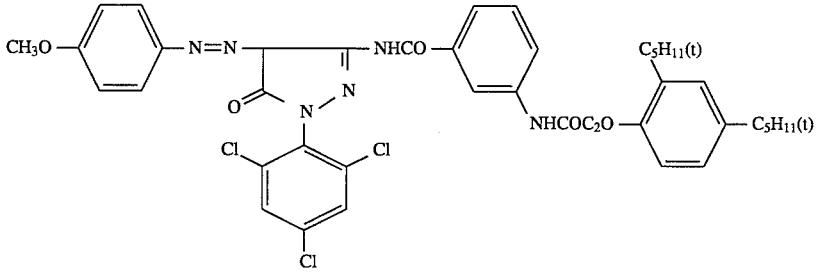

Y-1

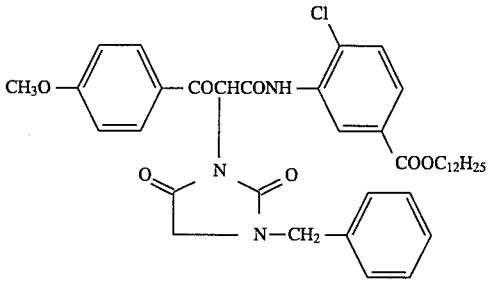

-continued
Y-2
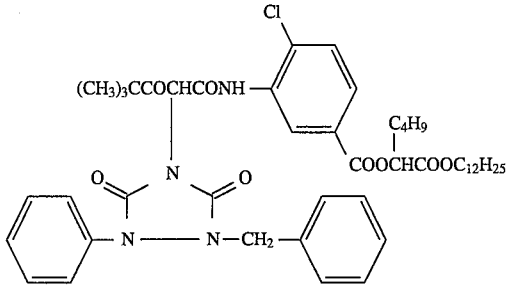
CC-1
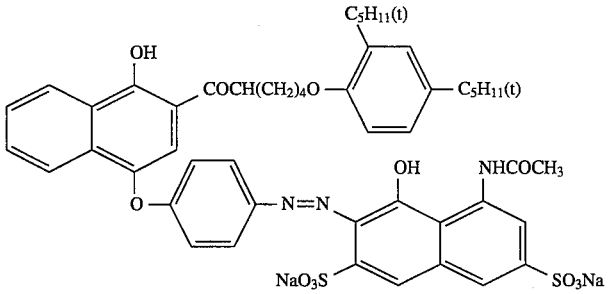
D-1
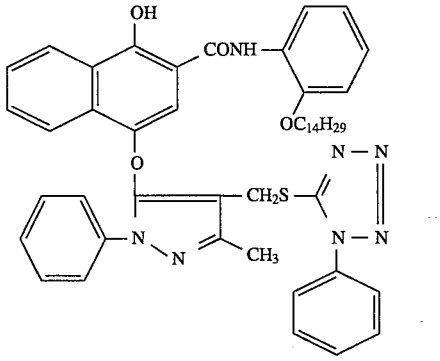
D-2
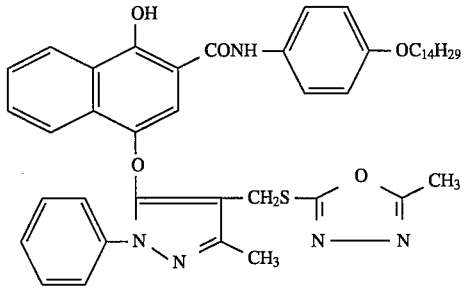
D-3
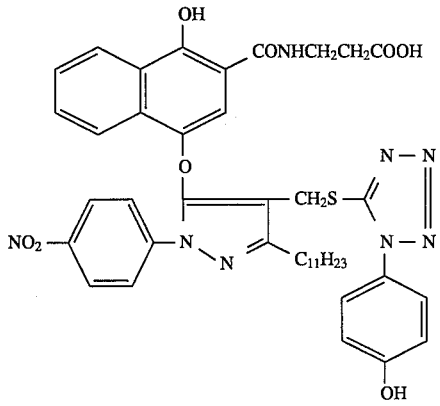

-continued
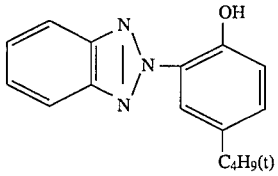
UV-1
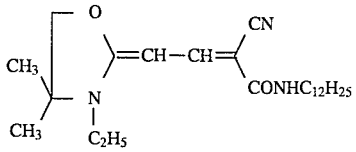
UV-2
Mixture of
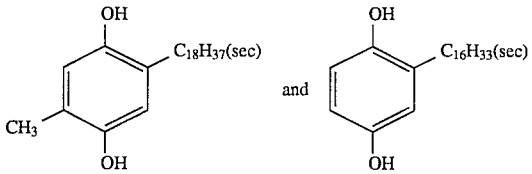
SC-1
(Mixing ratio = 2:3)
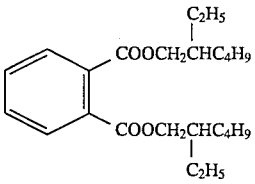
Oil-1
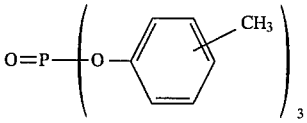
Oil-2
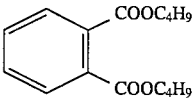
Oil-3
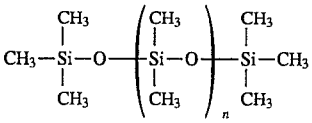
Compound A
Weight average molecular weight Mw = 3,000
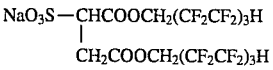
Compound B
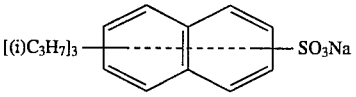
SU-1
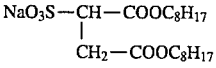
SU-2
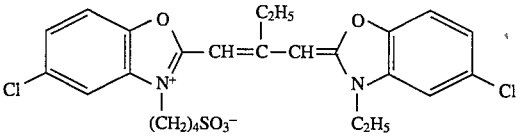
S-1

-continued
S-2
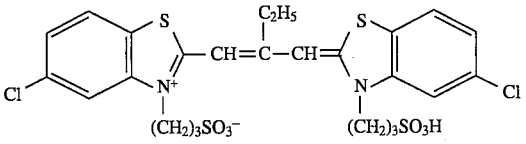
S-3
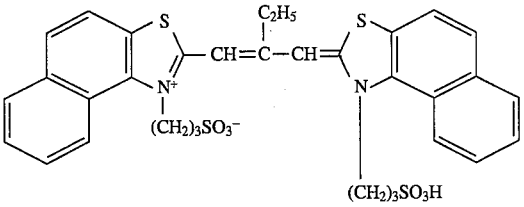
S-4
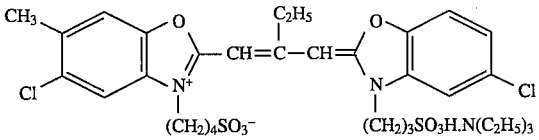
S-5
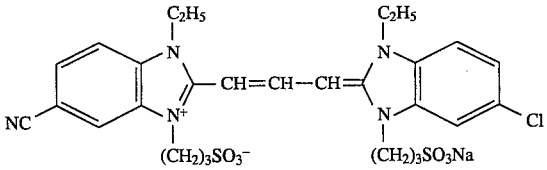
S-6
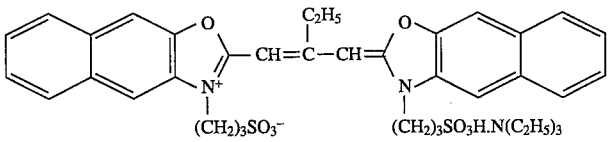
S-7
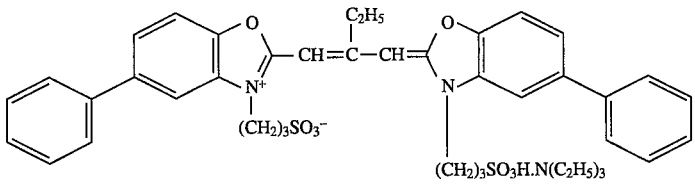
S-8
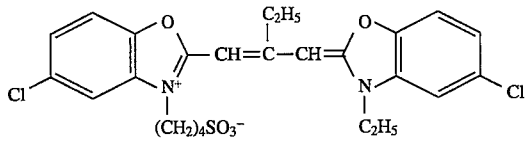
S-9
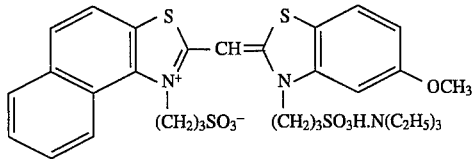
S-10
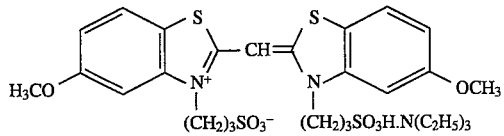
S-11
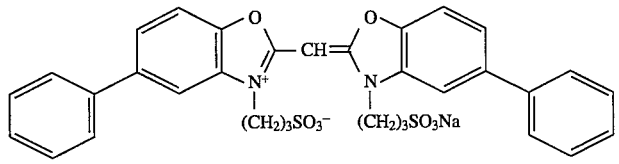

-continued

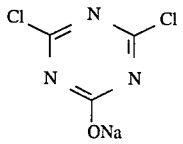

H-1

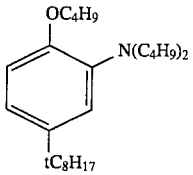

Additive 1

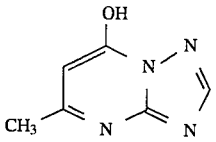

ST-1

Mixture of

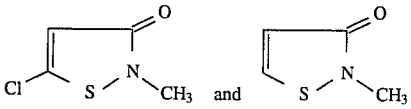

DI-1

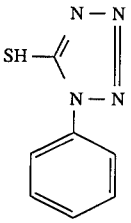

AF-1

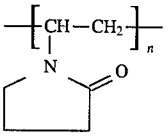

AF-2

Mw : 9,000

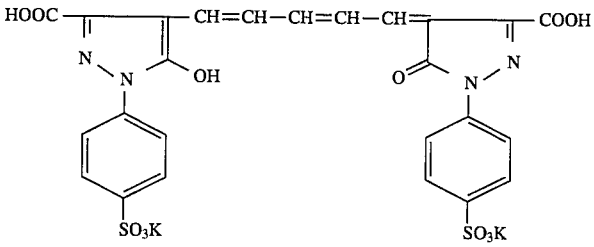

AI-1

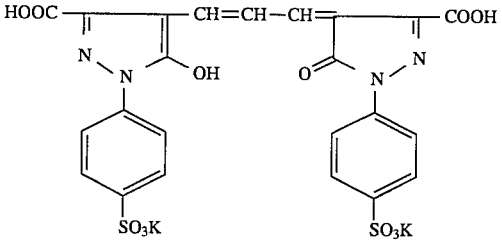

AI-2

Samples 2 to 15 were prepared in the same manner as in Sample 1 except that the magenta coupler to be contained in 6th and 7th layer was changed as shown in Table 2.

In each of the samples, the molar amount of the coupler in the sample was the same as that of coupler M-a in Sample 1.

Samples 1 to 15 were each exposed to green light through an optical wedge and were processed under the following conditions.

| Processing step | Processing time | Processing temperature (°C.) | Replenishing amount (ml) |
|---|---|---|---|
| Color Dev. | 3' 15" | 38 ± 0.3 | 780 |
| Bleaching | 45" | 38 ± 2.0 | 150 |
| Fixing | 1' 30" | 38 ± 2.0 | 830 |
| Stabilizing | 60" | 38 ± 5.0 | 830 |
| Drying | 60" | 55 ± 5.0 | — |

In the above the replenishing is a volume per square meter of light-sensitive material.

The following color developer, bleaching solution, fixer and stabilizer and replenisher therefor were used in the processing.

| Color developer | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-(β-hydroxyethyl)aniline sulfate | 4.5 g |
| Diethylenetriaminepentaacetic acid | 3.0 g |
| Potassium hydroxide | 1.2 g |

Make to 1 liter with water and adjust pH value to 10.06 by sodium hydroxide or 20% sulfuric acid.

| Color developer replenisher | |
|---|---|
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-(β-hydroxyethyl)aniline sulfate | 6.3 g |
| Diethylenetriaminepentaacetic acid | 3.0 g |
| Potassium hydroxide | 2 g |

Make to 1 liter with water and adjust pH value to 10.18 by potassium hydroxide or 20% sulfuric acid.

| Bleaching solution | |
|---|---|
| Water | 700 ml |
| Ferric ammonium 1,3-diamino-propanetetraaetate | 125 g |
| ethylenediaminetetraacetic acid | 2 g |
| Sodium nitrate | 40 g |
| Ammonium bromide | 150 g |
| Glacial acetic acid | 40 g |

Make to 1 liter with water and adjust pH value to 4.4 by ammonia water or glacial acetic acid.

| Bleaching replenisher | |
|---|---|
| Water | 700 ml |
| Ferric ammonium 1,3-diamino-propanetetraaetate | 175 g |
| ethylenediaminetetraacetic acid | 2 g |
| Sodium nitrate | 50 g |

-continued

| Bleaching replenisher | |
|---|---|
| Ammonium bromide | 200 g |
| Glacial acetic acid | 56 g |

Adjust pH value to 4.0 by ammonia water or glacial acetic acid and make to 1 liter with water.

| Fixer | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Adjust pH value to 6.2 by ammonia water or glacial acetic acid and make to 1 liter with water.

| Fixer replenisher | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Adjust pH value to 6.5 by ammonia water or glacial acetic acid and make to 1 liter with water.

| Stabilizer and stabilizer replenisher | |
|---|---|
| Water | 900 ml |
| $p\text{-}C_8H_{17}\text{-}C_6H_4\text{-}O\text{-}(CH_2CH_2O)_{10}H$ | 2.0 g |
| Dimethylolurea | 0.5 g |
| Hexamethylenetetramine | 0.2 g |
| 1,2-benzo-iso-thiazoline-3-one | 0.1 g |
| Siloxane (L-77 produced by UCC Co.) | 0.1 g |
| Ammonia water | 0.5 ml |

Make to 1 liter with water and adjust pH value to 8.5 using ammonia water of 50% sulfuric acid After processing the samples were subjected to densitometery with green light, and sensitometric characteristics of the samples were measured.

Sensitivity of the sample was determined as the reciprocal of exposure amount necessary to form a density of 0.3 on the fog density. Thus obtained results are listed in Table 2. In Table 2, the sensitivity of the sample is given as a relative value when the sensitivity of Sample 1 is set at 100.

TABLE 2

| Sample No. | Magenta coupler in 6th and 7th layers | Sensitivity | Maximum density | Note |
|---|---|---|---|---|
| 1 | M-a | 101 | 1.26 | Comparative |
| 2 | M-b | 107 | 1.40 | Comparative |
| 3 | Ex. Compound 1 | 200 | 2.22 | Inventive |
| 4 | Ex. Compound 2 | 202 | 2.21 | Inventive |
| 5 | Ex. Compound 3 | 198 | 2.18 | Inventive |
| 6 | Ex. Compound 7 | 201 | 2.15 | Inventive |
| 7 | Ex. Compound 8 | 201 | 2.31 | Inventive |
| 8 | Ex. Compound 9 | 200 | 2.34 | Inventive |
| 9 | Ex. Compound 11 | 210 | 1.93 | Inventive |
| 10 | Ex. Compound 12 | 205 | 1.89 | Inventive |
| 11 | Ex. Compound 15 | 209 | 2.36 | Inventive |
| 12 | Ex. Compound 25 | 200 | 2.18 | Inventive |
| 13 | Ex. Compound 26 | 199 | 2.28 | Inventive |

TABLE 2-continued

| Sample No. | Magenta coupler in 6th and 7th layers | Sensitivity | Maximum density | Note |
|---|---|---|---|---|
| 14 | Ex. Compound 27 | 200 | 2.28 | Inventive |
| 15 | Ex. Compound 28 | 200 | 2.10 | Inventive |

Ex. Compound: Exemplified compound
M-b (Comparative coupler)

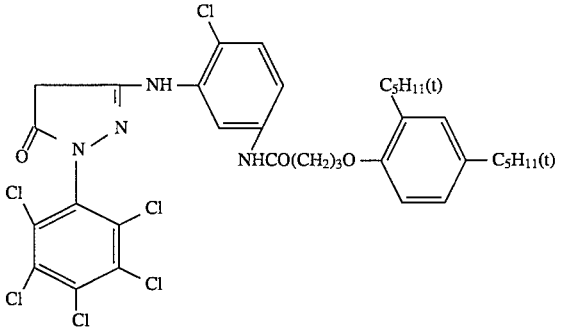

As is obvious from Table 2, Samples 3 to 15, in which couplers of the invention are used, are each higher than those of Samples 1 and 2, in which the comparative couplers used. Accordingly, thickness of emulsion layer and amount of magenta coupler in a silver halide light-sensitive material can be reduced by making use of the coupler of the invention. As a result of that, sharpness of the light-sensitive material can be raised.

What is claimed is:

1. A silver halide color photographic light-sensitive material comprising a support, provided thereon, a blue-sensitive silver halide emulsion layer, a green-sensitive silver halide emulsion layer and a red-sensitive silver halide emulsion layer, in which said green-sensitive emulsion layer contains a coupler represented by the following Formula I;

Formula I

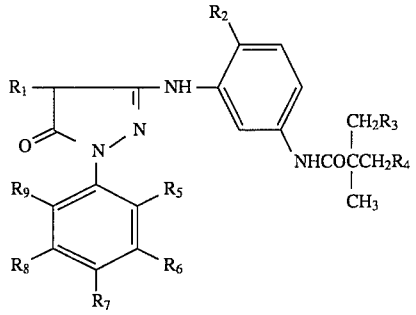

wherein $R_1$ is a hydrogen atom or a group capable of being released upon reaction with the oxidation product of a color developing agent; $R_2$ is a chlorine atom or an alkoxyl group; $R_3$ and $R_4$ are each independently a hydrogen atom, an alkyl group, an aryl group, an alkoxyl group, an aryloxy group, an acyloxy group, a halogen atom, a hydroxyl group, an amino group, an alkylamino group, an acylamino group or a sulfonamido group, $R_3$ and $R_4$ may be linked with together to form a ring, provided that at least one of $R_3$ and $R_4$ is a group represented by —$OR_{10}$ or —$OOCR_{11}$ in which $R_{10}$ is a hydrogen atom, an alkyl group, or an aryl group, and $R_{11}$ is an alkyl group or an aryl group; and $R_5$, $R_6$, $R_7$, $R_8$ and $R_9$ are each a halogen atom.

2. The light-sensitive material of claim 1, wherein the group capable of releasing upon reaction with the oxidation product of a color developing agent represented by $R_1$ is a phenylthio group, carboxylpropylthio group or a octylthio group.

3. The light-sensitive material of claim 1, wherein said coupler represented by Formula I is contained in said green-sensitive silver halide emulsion layer in an amount of $1\times10^{-3}$ moles to $8\times10^{-1}$ moles per mole of silver.

* * * * *